US009077081B2

(12) United States Patent
Wakabayashi

(10) Patent No.: US 9,077,081 B2
(45) Date of Patent: Jul. 7, 2015

(54) MULTI-ANTENNA DEVICE AND COMMUNICATION APPARATUS

(71) Applicant: Funai Electric Co., Ltd., Daito, Osaka (JP)

(72) Inventor: Naoyuki Wakabayashi, Osaka (JP)

(73) Assignee: FUNAI ELECTRIC CO., LTD., Osaka (JP)

( * ) Notice: Subject to any disclaimer, the term of this patent is extended or adjusted under 35 U.S.C. 154(b) by 172 days.

(21) Appl. No.: 13/685,091

(22) Filed: Nov. 26, 2012

(65) Prior Publication Data

US 2013/0162496 A1 Jun. 27, 2013

(30) Foreign Application Priority Data

Dec. 26, 2011 (JP) ..... 2011-282843

(51) Int. Cl.
*H01Q 1/38* (2006.01)
*H01Q 21/00* (2006.01)
*H01Q 9/30* (2006.01)

(52) U.S. Cl.
CPC ..... *H01Q 21/00* (2013.01); *H01Q 21/0006* (2013.01); *H01Q 1/38* (2013.01); *H01Q 9/30* (2013.01)

(58) Field of Classification Search
USPC ..... 343/700 MS, 702, 850, 853
See application file for complete search history.

(56) References Cited

U.S. PATENT DOCUMENTS

| | | | | |
|---|---|---|---|---|
| 6,218,989 | B1 * | 4/2001 | Schneider et al. | 343/700 MS |
| 7,965,242 | B2 * | 6/2011 | Abramov et al. | 343/702 |
| 2008/0136710 | A1 | 6/2008 | Nefedov et al. | |
| 2010/0013720 | A1 * | 1/2010 | Sakata et al. | 343/702 |

FOREIGN PATENT DOCUMENTS

| | | | |
|---|---|---|---|
| EP | 0720252 | A1 | 7/1996 |
| EP | 1768211 | A1 | 3/2007 |
| EP | 2328228 | A1 | 6/2011 |
| JP | 4267003 | | 5/2009 |
| JP | 2012-105125 | A | 5/2012 |
| WO | 2010065356 | A1 | 6/2010 |
| WO | 2011087177 | A1 | 7/2011 |

OTHER PUBLICATIONS

Extended European Search Report of the corresponding European Application No. 12199283.8, dated Mar. 14, 2013.

* cited by examiner

*Primary Examiner* — Dieu H Duong
(74) *Attorney, Agent, or Firm* — Global IP Counselors, LLP

(57) ABSTRACT

A multi-antenna device includes a feeding element and a passive element. The feeding element has first and second antenna elements. The passive element is disposed between the first and second antenna elements. The passive element has a first portion that is grounded at one end, a second portion that is grounded at one end and a third portion that is grounded at one end via a serially connected member with inductance. The third portion is connected at the other end to the other ends of the first and second portions.

10 Claims, 11 Drawing Sheets

MULTI-ANTENNA DEVICE AND COMMUNICATION APPARATUS

CROSS-REFERENCE TO RELATED APPLICATIONS

This application claims priority to Japanese Patent Application No. 2011-282843 filed on Dec. 26, 2011. The entire disclosure of Japanese Patent Application No. 2011-282843 is hereby incorporated herein by reference.

BACKGROUND

1. Field of the Invention

The present invention generally relates to a multi-antenna device and a communication apparatus. More specifically, the present invention relates to a multi-antenna device and a communication apparatus having a plurality of antenna elements.

2. Background Information

Conventionally, multi-antenna devices with a plurality of antenna elements are known (see Japanese Patent No. 4,267,003 (Patent Citation 1), for example).

The conventional multi-antenna device includes a MIMO array antenna with a pair of antenna elements and an isolator (e.g., passive element). The antenna elements are disposed spaced apart by a distance that is one-half the wavelength λ of the corresponding electrical wave. The isolator includes an isolating element that is disposed between the two antenna elements to suppress cross coupling between the two antenna elements. The isolating element has a length that is one-quarter the wavelength λ. The isolating element is formed so as to extend in a direction in which the two antenna elements oppose each other.

SUMMARY

With the MIMO array antenna of the multi-antenna device of the above-mentioned Patent Citation 1, although cross coupling between the antenna elements can be suppressed by providing the isolator with the isolating element, the isolating element with the length that is one-quarter the wavelength λ has to be disposed so as to extend in the direction in which the two antenna elements oppose each other. Thus, it has been discovered that it is difficult to make the distance between the antenna elements short enough. Therefore, it has also been discovered that it is difficult to reduce the size of the MIMO array antenna of the multi-antenna device.

One object of the present disclosure is to provide a multi-antenna device with which cross coupling between antenna elements can reduced, and a more compact size can be achieved. Another object of the present disclosure is to provide a communication apparatus with this multi-antenna device.

In view of the state of the know technology, a multi-antenna device includes a feeding element and a passive element. The feeding element has first and second antenna elements. The passive element is disposed between the first and second antenna elements. The passive element has a first portion that is grounded at one end, a second portion that is grounded at one end and a third portion that is grounded at one end via a serially connected member with inductance. The third portion is connected at the other end to the other ends of the first and second portions.

Other objects, features, aspects and advantages of the present disclosure will become apparent to those skilled in the art from the following detailed description, which, taken in conjunction with the annexed drawings, discloses a preferred embodiment of a multi-antenna device and a communication apparatus.

BRIEF DESCRIPTION OF THE DRAWINGS

Referring now to the attached drawings which form a part of this original disclosure.

DETAILED DESCRIPTION OF EMBODIMENTS

A preferred embodiment will now be explained with reference to the drawings. It will be apparent to those skilled in the art from this disclosure that the following descriptions of the embodiment are provided for illustration only and not for the purpose of limiting the invention as defined by the appended claims and their equivalents.

Referring initially to FIGS. 1 to 4, a portable telephone 100 is illustrated in accordance with one embodiment. The portable telephone 100 is an example of a "communication apparatus" of the present application.

Figure 1:
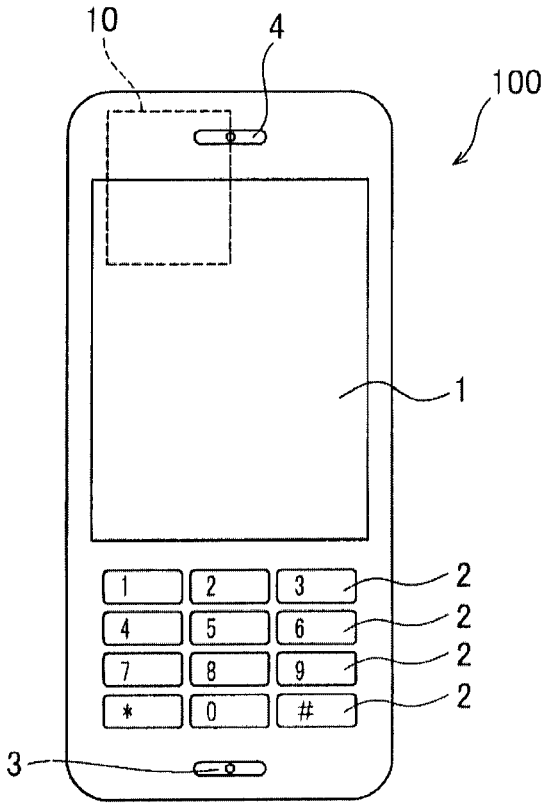
FIG. 1 is a front elevational view a portable telephone in accordance with one embodiment of the present application.

As shown in FIG. 1, the portable telephone 100 has a substantially rectangular shape as seen from the front. The portable telephone 100 includes a display screen component 1, interface components 2 with number buttons or the like, a microphone 3, a speaker 4, and a multi-antenna device 10 (e.g., a multi-antenna apparatus). The multi-antenna device 10 is disposed inside the housing of the portable telephone 100.

The multi-antenna device 10 is configured for MIMO (multiple-input multiple-output) communication in which multiplex input and output is possible at a specific frequency by using a plurality of antenna elements. The multi-antenna device 10 is also compatible with WiMAX (worldwide interoperability for microwave access) on a high-speed wireless communications network in the 2.5 GHz band.

Figure 2:
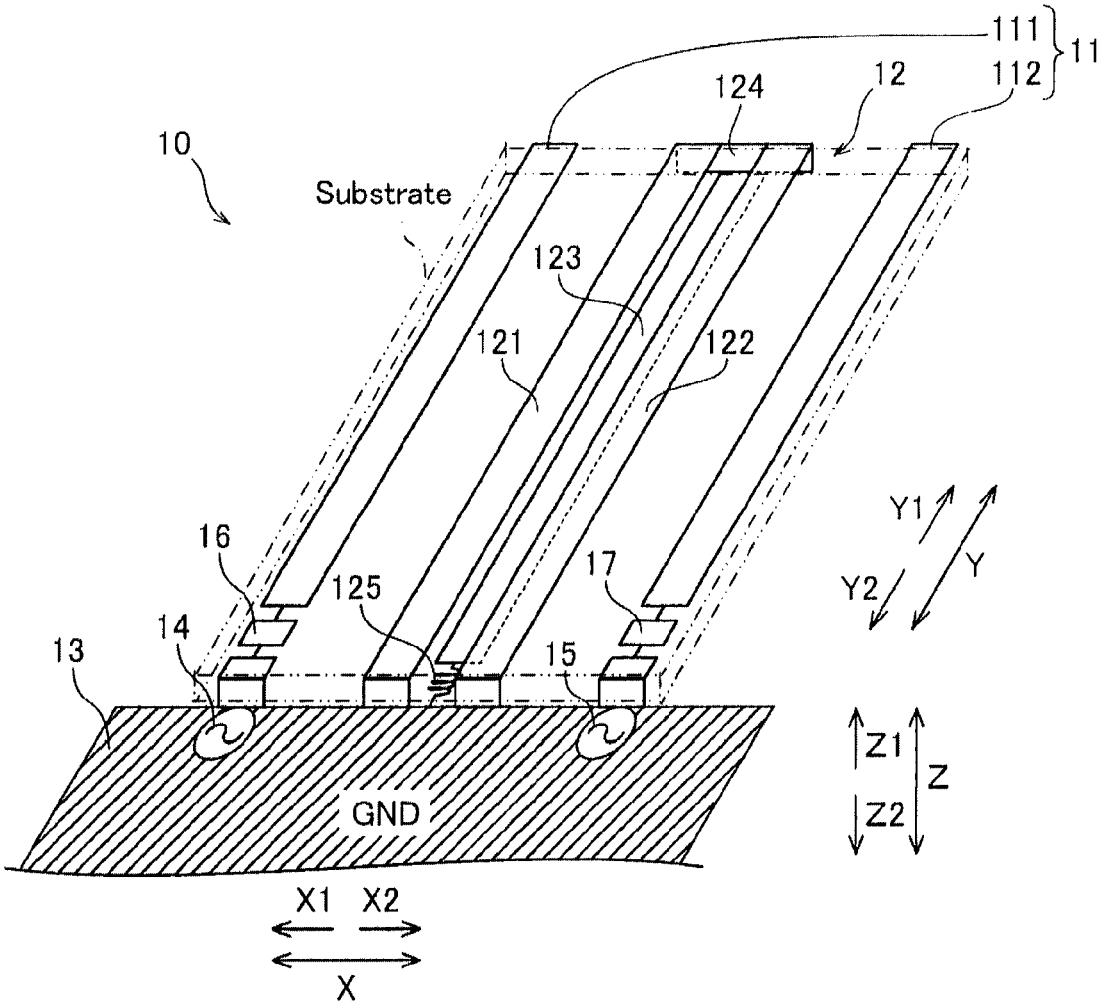
FIG. 2 is a simplified perspective view of a multi-antenna device of the portable telephone illustrated in FIG. 1.
Figure 3:
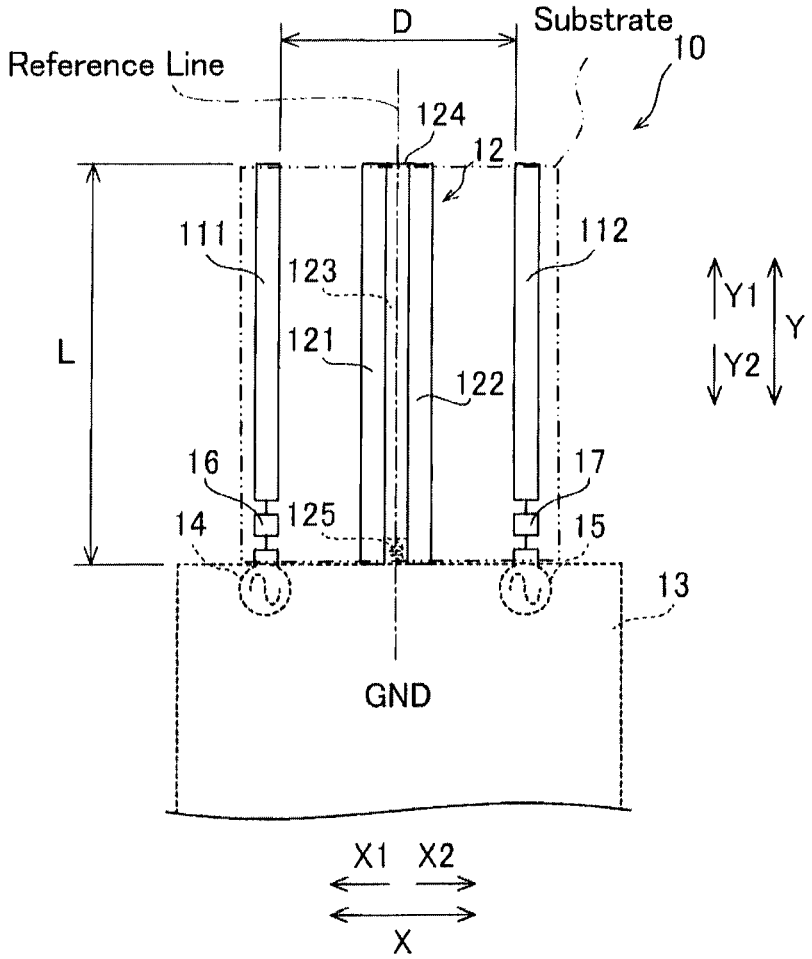
FIG. 3 is a front elevational view of a substrate of the multi-antenna device of the portable telephone illustrated in FIG. 1.
Figure 4:
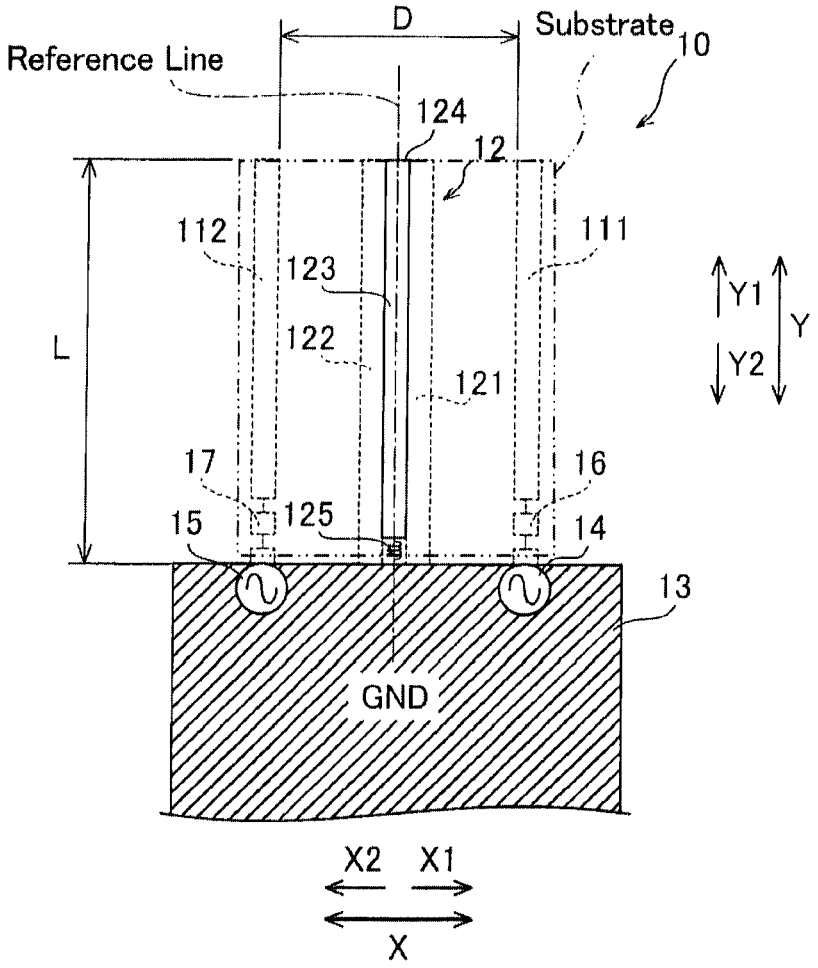
FIG. 4 is a rear elevational view of the substrate of the multi-antenna device of the portable telephone illustrated in FIG. 1.

More specifically, as shown in FIGS. 2 to 4, the multi-antenna device 10 includes a feeding element 11 with first and second antenna elements 111 and 112, a passive element or isolator 12, and a grounding surface 13. The passive element 12 is disposed between the first and second antenna elements 111 and 112. The multi-antenna device 10 further includes first and second feed points 14 and 15, and first and second matching circuits 16 and 17. The first feed point 14 supplies high-frequency power (e.g., first high-frequency power) to the first antenna element 111. The second feed point 15 supplies high-frequency power (e.g., second high-frequency power) to the second antenna element 112. The first and second matching circuits 16 and 17 are arranged for impedance matching.

The first antenna element 111 is disposed on the X1 direction side of the passive element 12 relative to the passive element 12 along the X direction of the multi-antenna device 10. The second antenna element 112 is disposed on the X2 direction side of the passive element 12 relative to the passive element 12 along the X direction of the multi-antenna device 10. The first antenna element 111 and the second antenna element 112 are formed in the form of a thin strip, and are provided on the surface on the front side (i.e. the Z1 direction side) of a substrate of the multi-antenna device 10. As shown in FIGS. 3 and 4, the first antenna element 111 and the second antenna element 112 are formed in linear symmetry to each other and with respect to a reference line that passes through the center point between the first feed point 14 and the second feed point 15 and that is perpendicular to a line connecting or extending between the first feed point 14 and the second feed point 15. Also, the first antenna element 111 and the second antenna element 112 have a linear shape extending in the Y direction of the multi-antenna device 10 that is perpendicular to the X direction in which the first and second antenna elements 111 and 112 are opposite one another. Each of the first and second antenna elements 111 and 112 also includes a monopole antenna having an electrical length of approximately one-fourth the wavelength λ of 2.5 GHz to which the multi-antenna device 10 corresponds (e.g., the wavelength λ of 2.5 GHz to which the multi-antenna device 10 desires to handle). Also, the first antenna element 111 and the second antenna element 112 are disposed such that the distance D by which they are separated from one another along the X direction is less than λ/4. The "electrical length" here is not one wavelength in a vacuum, but rather a length based on one wavelength of a signal moving through the conductor constituting the antenna. The first and second antenna elements 111 and 112 are open at one ends on the Y1 direction side, respectively, while the other ends on the Y2 direction side are grounded to the grounding surface 13 via the first and second feed points 14 and 15, respectively.

The passive element 12 is configured so as to be oscillated or resonated at a frequency corresponding to the 2.5 GHz band (i.e., a frequency near 2.5 GHz) by the current flowing through the first antenna element 111 and the second antenna element 112. The passive element 12 has a first portion 121 that is coupled to the feeding element 11, a second portion 122 that is coupled to the feeding element 11, and a third portion 123 that is disposed between the first portion 121 and the second portion 122 in plan view. In this embodiment, the term "coupled" or "coupling" means electromagnetic coupling, which includes both electrostatic coupling and magnetic coupling. More specifically, the term "coupled" or "coupling" means indirect or contact-less coupling, such as inductive coupling, capacitive coupling or other electromagnetic coupling utilizing electromagnetic induction.

The first portion 121 and the second portion 122 are each grounded at the end on the Y2 direction side to the grounding surface 13. Also, the first portion 121 and the second portion 122 are each connected to the end of the third portion 123 on the Y1 direction side via a connector 124. The third portion 123 is grounded at its end on the Y2 direction side to the grounding surface 13 via a serially connected inductor 125. With the multi-antenna device 10, corresponding to the 2.5 GHz band, the inductor 125 has an inductance of approximately 10 nH (nanohenry). The inductor 125 is also an example of a "member" of the present application. The first portion 121 is disposed more on the first antenna element 111 side (e.g., the X1 direction side) than the second portion 122 and the third portion 123. In other words, the first portion 121 is closer to the first antenna element 111 than the second and third portions 122 and 123 are. The second portion 122 is disposed more on the second antenna element 112 side (e.g., the X2 direction side) than the first portion 121 and the third portion 123. In other words, the second portion 122 is closer to the second antenna element 112 than the first and third portions 121 and 123. In plan view, the first portion 121 and the second portion 122 are disposed so as to be opposite the first antenna element 111 and the second antenna element 112, respectively.

The first portion 121 and the second portion 122 are similar to the first antenna element 111 and the second antenna element 112 in that they are provided on the surface on the front side (i.e., the Z1 direction side) of a substrate of the multi-antenna device 10. The third portion 123, unlike the first portion 121 and the second portion 122, is provided on the surface on the back side (i.e., the Z2 direction side) of the substrate of the multi-antenna device 10. Specifically, the first portion 121 and the second portion 122 are connected to the third portion 123 via the connector 124 straddling the substrate between the front and back of the substrate at their ends on the Y1 direction side. Also, the first, second and third portions 121, 122 and 123 each have a linear shape extending in the Y direction that is perpendicular to the X direction in which the first antenna element 111 and the second antenna element 112 are opposite one another. The first, second and third portions 121, 122 and 123 each have an electrical length L of approximately λ/4. The passive element 12 is formed such that the distance in the Y direction from the end of the passive element 12 on the opposite side (i.e., the Y1 direction side) of the side on which the grounding surface 13 is disposed to the grounding surface 13 is substantially the same as the distance in the Y direction from the end of the feeding element 11 in the Y1 direction side to the grounding surface 13. Consequently, space in the Y direction does not have to be expanded or increased to dispose both the feeding element 11 and the passive element 12. Accordingly, the multi-antenna device 10 can be made more compact.

The first portion 121, the second portion 122, and the third portion 123 are disposed in parallel and adjacent to one another in the X direction. More specifically, as shown in FIGS. 3 and 4, in plan view they are disposed so that the edge of the first portion 121 on the X2 direction side aligns the edge of the third portion 123 on the X1 direction side along the same straight line, and are disposed so that the edge of the third portion 123 on the X2 direction side aligns the edge of the second portion 122 of the X1 direction side along the same straight line. Specifically, in plan view the first portion 121, the second portion 122, and the third portion 123 do not superpose each other, except for the edges. The first portion 121 and the second portion 122 are separated by the X direction width (such as 1 mm) of the third portion 123 in the X direction. The first portion 121 and the second portion 122 are also each separated from the third portion 123 by the Z direction thickness (such as 1 mm) of the substrate of the multi-antenna device 10 in the Y direction. In this embodiment, the Z direction thickness of the substrate and the X direction width of the third portion 123 are each less than an electrical length of approximately one-tenth the wavelength λ of 2.5 GHz to which the multi-antenna device 10 corresponds. Therefore, the first portion 121, the second portion 122, and the third portion 123 are disposed so as to be separated from one another at a spacing that is less than an electrical length of approximately λ/10.

The first and second feed points 14 and 15 are disposed at the ends of the first and second antenna elements 111 and 112 on the Y2 direction side, respectively. The first and second feed points 14 and 15 also connect a power line (not shown) to the first and second antenna elements 111 and 112, respectively.

Figure 5:
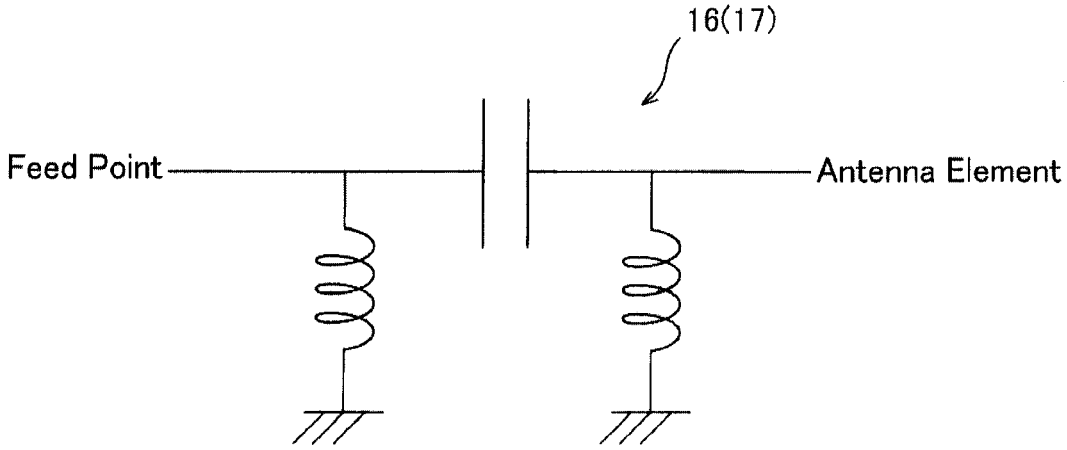
FIG. 5 is a simplified circuit diagram of a π-shaped matching circuit of the multi-antenna device of the portable telephone illustrated in FIG. 1.

The first matching circuit 16 is disposed between the first antenna element 111 and the first feed point 14, while the second matching circuit 17 is disposed between the second antenna element 112 and the second feed point 15. The first matching circuit 16 performs impedance matching at a specific frequency of the high-frequency power (e.g., first high-frequency power, while the second matching circuit 17 performs impedance matching at a specific frequency of the high-frequency power (e.g., second high-frequency power). In particular, the first and second matching circuits 16 and 17 are configured so as to achieve impedance matching at the 2.5 GHz to which the multi-antenna device 10 corresponds. More specifically, as shown in FIG. 5, the first and second matching circuits 16 and 17 form a π-shaped circuit (e.g., π matching) with an inductor (e.g., a coil) and a capacitor (e.g., a condenser).

In this embodiment, the passive element 12 disposed between the first antenna element 111 and the second antenna element 112 is configured to include the first portion 121, which is coupled to the feeding element 11 and grounded at one end, the second portion 122, which is coupled to the feeding element 11 and grounded at one end, and the third portion 123, which is grounded at one end via the serially connected inductor 125 with inductance and is connected at the other end to the other ends of the first portion 121 and the second portion 122. As a result, cross coupling between the antenna elements 111 and 112 can be reduced, without forming the passive element 12 including the first portion 121, the second portion 122, and the third portion 123 so as to extend in the direction in which the first antenna element 111 and the second antenna element 112 are opposite each other. Consequently, there is no need to increase the distance between the antenna elements 111 and 112 in order to reduce cross coupling between the antenna elements 111 and 112. Furthermore, the distance between the antenna elements 111 and 112 can be shortened, unlike when the passive element 12 is formed so as to extend in the direction in which the first antenna element 111 and the second antenna element 112 are opposite each other. Therefore, with the multi-antenna device 10 of this portable telephone 100, cross coupling between the antenna elements 111 and 112 can be reduced, and a more compact size can be attained. Also, the portable telephone 100 equipped with this multi-antenna device 10 can itself be made more compact. The present application is particularly effective in communication apparatuses where a smaller size is desirable, such as the portable telephone 100 of this embodiment.

Also, the passive element 12 is configured so as to include the first portion 121, which is coupled to the feeding element 11 and grounded at one end, the second portion 122, which is coupled to the feeding element 11 and grounded at one end, and the third portion 123, which is grounded at one end via the serially connected inductor 125 and is connected at the other end to the other ends of the first portion 121 and the second portion 122. Thus, adjustment of frequency that allows the cross coupling between the antenna elements 111 and 112 to be effectively reduced can be easily accomplished merely by adjusting the length of the various components of the passive element 12 (i.e., the first portion 121, the second portion 122, and the third portion 123). As a result, the design of the multi-antenna device 10 can be simplified.

As discussed above, it is discovered that the cross coupling between the antenna elements 111 and 112 can be reduced while achieving a more compact size if the passive element 12 disposed between the first antenna element 111 and the second antenna element 112 is configured to include the first portion 121, which is coupled to the feeding element 11 and grounded at one end, the second portion 122, which is coupled to the feeding element 11 and grounded at one end, and the third portion 123, which is grounded at one end via the serially connected inductor 125 and is connected at the other end to the other ends of the first portion 121 and the second portion 122.

Also, in this embodiment, the first portion 121 of the passive element 12 is disposed more to the first antenna element 111 side (i.e., the X1 direction side) than the second portion 122 and the third portion 123, while the second portion 122 of the passive element 12 is disposed more to the second antenna element 112 side (i.e., the X2 direction side) than the first portion 121 and the third portion 123. Consequently, the first portion 121 of the passive element 12 can be reliably coupled to the first antenna element 111, and the second portion 122 can be reliably coupled to the second antenna element 112. As a result, cross coupling between the antenna elements 111 and 112 can be more reliably reduced, and the distance between the antenna elements 111 and 112 can be shortened.

Also, in this embodiment, the third portion 123 of the passive element 12 is disposed in a different plane (i.e., the surface on the back side of the substrate) from that of both the first portion 121 and the second portion 122. Consequently, in plan view the third portion 123 of the passive element 12 can be disposed so as to be close to or superpose both the first portion 121 and the second portion 122. As a result, the passive element 12 can be disposed in a smaller space.

Also, in this embodiment, the first portion 121, the second portion 122, and the third portion 123 of the passive element 12 are configured so as to have an electrical length that is approximately one-fourth the wavelength λ of radio waves outputted by the first antenna element 111 and the second antenna element 112. Consequently, the passive element 12 including the first portion 121, the second portion 122, and the third portion 123 can oscillate or resonate near the corresponding frequency (e.g., 2.5 GHz).

Also, in this embodiment, the first matching circuit 16, for impedance matching at a specific frequency (e.g., 2.5 GHz) of high-frequency power, is provided between the first antenna element 111 and the first feed point 14, while the second matching circuit 17, for impedance matching at a specific frequency (e.g., 2.5 GHz) of high-frequency power, is provided between the second antenna element 112 and the second feed point 15. Consequently, at a specific frequency, cross coupling between the antenna elements 111 and 112 can be reduced and impedance matching can be achieved. Thus, transmission loss of the energy transmitted to the antenna elements 111 and 112 can be reduced.

Also, in this embodiment, the first portion 121, the second portion 122, and the third portion 123 of the passive element 12 are disposed so as to be separated from one another by the distance that is less than the electrical length of approximately one-tenth the wavelength λ of radio waves outputted by the first antenna element 111 and the second antenna element 112. Consequently, the second portion 122 and the third portion 123 can be disposed so that they are closer together, and the passive element 12 can be disposed in a smaller space. As a result, the multi-antenna device 10 can be made even more compact.

Also, in this embodiment, the first portion 121, the second portion 122, and the third portion 123 of the passive element 12 are disposed parallel to each other. Consequently, the first portion 121, the second portion 122, and the third portion 123 can be disposed closer together and alongside each other, and the passive element 12 can be disposed in a smaller space. As a result, an even more compact multi-antenna device 10 can be obtained.

Also, in this embodiment, the first portion 121, the second portion 122, and the third portion 123 of the passive element 12 are formed so as to extend linearly in the Y direction that is perpendicular to the X direction in which the first antenna element 111 and the second antenna element 112 are opposite one another. Consequently, the width of the passive element 12 can be reduced in the X direction in which the first antenna element 111 and the second antenna element 112 are opposite one another. As a result, the distance between the antenna elements 111 and 112 can be even smaller.

Next, the results of simulations showing the effect of this embodiment will be described. In this simulation, the multi-antenna device 10 in accordance with this embodiment and shown in FIGS. 2 to 4 will be compared with a multi-antenna device 110 that is a comparative example and shown in FIG. 6. The simulations are conducted for cases in which the electrical length L of each of the first portion 121, the second portion 122, and the third portion 123 in the multi-antenna device 10 is set to L=23 mm, L 24 mm, L=25 mm, or L=27 mm.

With the multi-antenna device 10 corresponding to this embodiment, the first antenna element 111 and the second antenna element 112 are disposed so that the separation distance D is 11 mm, or less than λ/4. In this simulation, the first antenna element 111, the second antenna element 112, and the passive element 12 are disposed on a glass epoxy substrate with a thickness of 1 mm, and this substrate is placed under a vacuum. Furthermore, in the simulation, the first antenna element 111, the second antenna element 112, and the passive element 12 are all conductors with a thickness of 0 mm. As mentioned above, the multi-antenna device 10 in this embodiment corresponds to 2.5 GHz, and the wavelength λ corresponding to 2.5 GHz is 120 mm.

Figure 6:
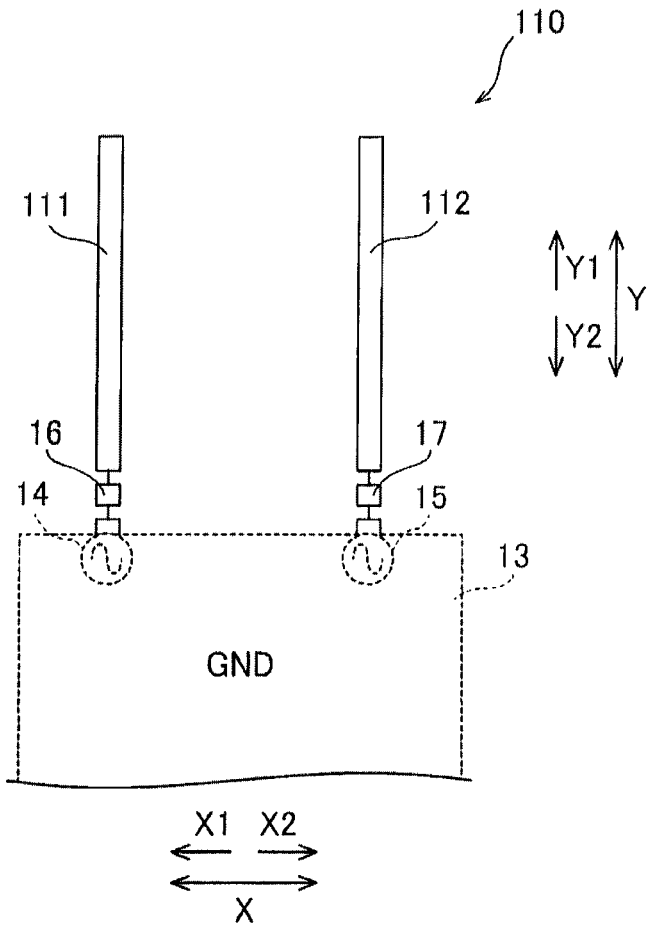
FIG. 6 is an elevational view of a multi-antenna device in a comparative example.

As shown in FIG. 6, with the multi-antenna device 110 of the comparative example, no passive element is provided between the antenna elements 111 and 112, which is in contrast to the multi-antenna device 10 pertaining to this embodiment in which the passive element 12 is provided. The rest of the configuration of the multi-antenna device 110 in the comparative example is the same as that of the multi-antenna device 10 corresponding to this embodiment.

Figure 7:
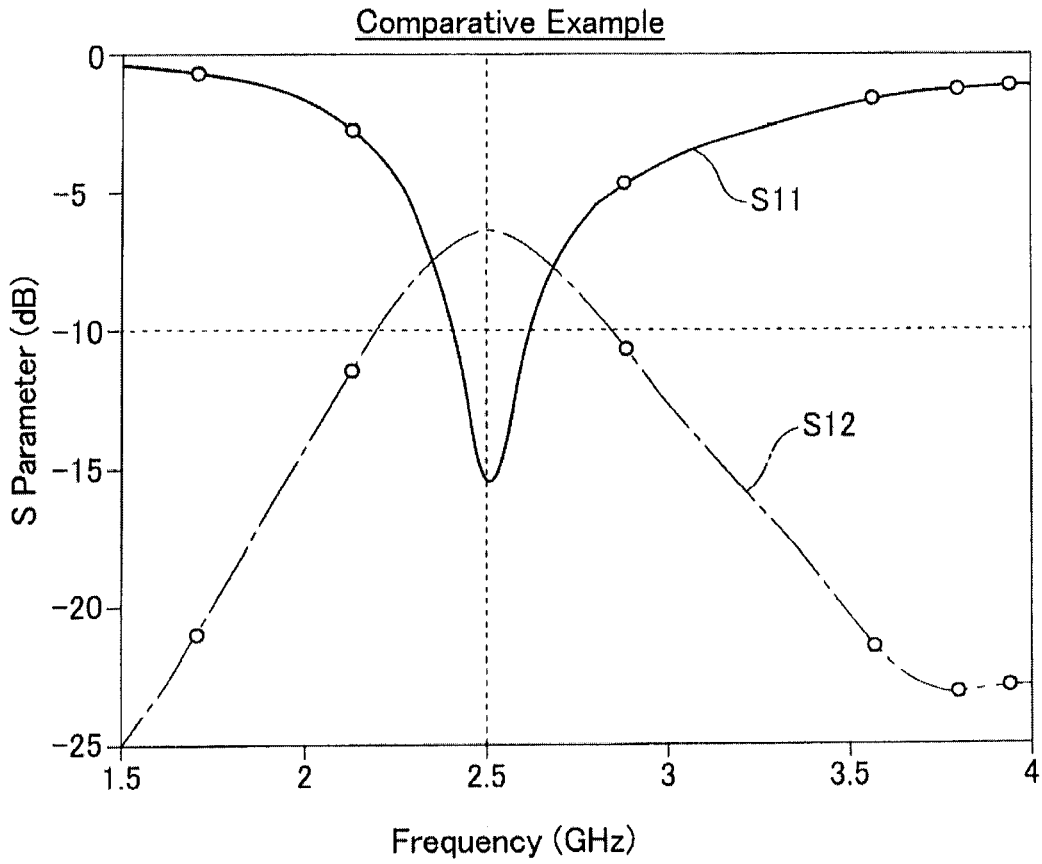
FIG. 7 is a graph illustrating a relationship between the frequency and the S parameter in a simulation of the multi-antenna device in the comparative example.
Figure 8:
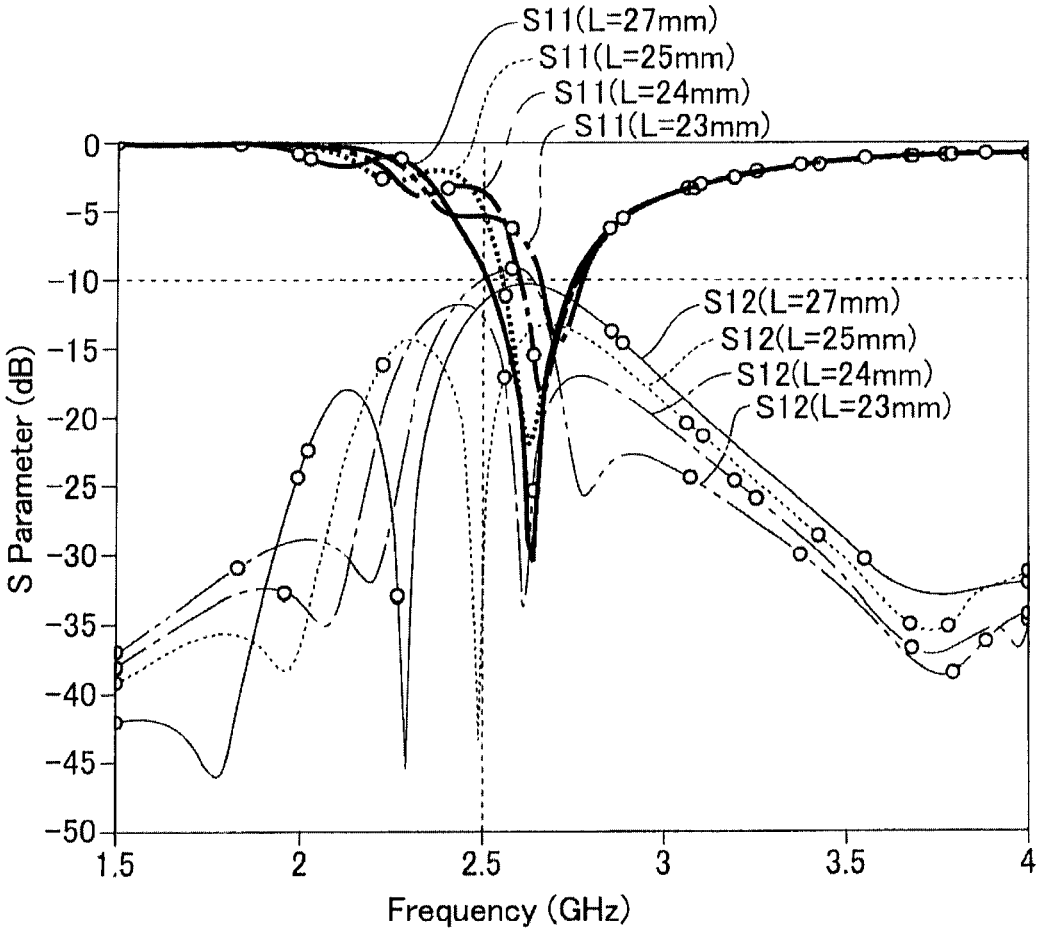
FIG. 8 is a graph illustrating a relationship between the frequency and the S parameter in a simulation of the multi-antenna device in accordance with one embodiment.

Referring to FIGS. 7 and 8, the characteristics of S parameters (i.e., scattering parameters) of the multi-antenna device 10 and the multi-antenna device 110 will be described.

First, as shown in FIG. 7, with the multi-antenna device 110 of the comparative example, the parameter S12 of S parameter is approximately −7 dB at the 2.5 GHz to which the multi-antenna device 10 of this embodiment corresponds. In contrast, as shown in FIG. 8, with the multi-antenna device 10, when the electrical length L of the first portion 121, the second portion 122, and the third portion 123 is set to L=23 mm in each case, the parameter S12 of S parameter is approximately −34 dB at the frequency at which the parameters S11 and S12 both decreased (e.g., at approximately 2.65 GHz).

As a result, the value of the parameter S12, which indicates the strength (or magnitude) of the cross coupling between two antenna elements, is smaller with the multi-antenna device 10 of this embodiment than with the multi-antenna device 110 of the comparative example. Thus, the cross coupling between the antenna elements 111 and 112 can be reduced by providing the passive element 12 having the first portion 121, the second portion 122, and the third portion 123. Generally speaking, if the value of the parameter S12 is −10 dB or less, it can be believed that the cross coupling between the antenna elements is minute.

This is believed to be due to the following reason. With the multi-antenna device 10 of this embodiment, the cross coupling between the antenna elements 111 and 112 is cancelled out by indirect coupling caused by current flowing through the passive element 12 and indirect coupling caused by current flowing through the other antenna element in the first antenna element 111 and the second antenna element 112.

As shown in FIG. 7, with the multi-antenna device 110 in the comparative example, the parameter S11 is approximately −15 dB. In contrast, as shown in FIG. 8, with the multi-antenna device 10 of this embodiment, when the electrical length L of the first portion 121, the second portion 122, and the third portion 123 is L=24 mm for each, the parameter S11 is approximately −20 dB at the frequency at which the parameters S11 and S12 both decreased (e.g., at approximately 2.65 GHz).

Therefore, the value of the parameter S11, which indicates the reflection coefficient of an antenna element, has a smaller value with the multi-antenna device 10 of the embodiment than with the multi-antenna device 110 of the comparative example. As a result, it is clear that radio waves can be outputted more efficiently from the antenna elements 111 and 112 of the multi-antenna device 10.

Next, the case in which the electrical length L of the first portion 121, the second portion 122, and the third portion 123 is changed in the multi-antenna device 10 of this embodiment will be described through reference to FIG. 8. When the electrical length L of the first portion 121, the second portion 122, and the third portion 123 is set to L=23 mm for each, the parameter S12 is approximately −26 d13 at approximately 2.8 GHz. When the electrical length L of the first portion 121, the second portion 122, and the third portion 123 is set to L=24 mm for each, the parameter S12 is approximately −34 dB at approximately 2.6 GHz. When the electrical length L of the first portion 121, the second portion 122, and the third portion 123 is set to L=25 mm for each, the parameter S12 is approximately −44 dB at approximately 2.5 GHz. When the electrical length L of the first portion 121, the second portion 122, and the third portion 123 is set to L=27 mm for each, the parameter S12 is approximately −45 dB at approximately 2.3 GHz.

Also, when the electrical length L of the first portion 121, the second portion 122, and the third portion 123 is set to L=23 mm for each, the parameter S11 is approximately −15 dB at approximately 2.75 GHz. When the electrical length L of the first portion 121, the second portion 122, and the third portion 123 is set to L=24 mm for each, the parameter S11 is approximately −18 dB at approximately 2.68 GHz. When the electrical length L of the first portion 121, the second portion 122, and the third portion 123 is set to L=25 mm for each, the parameter S11 is approximately −23 dB at approximately 2.65 GHz. When the electrical length L of the first portion 121, the second portion 122, and the third portion 123 is set to L=27 mm for each, the parameter S11 is approximately −30 dB at approximately 2.65 GHz.

As a result, when the electrical length L of the first portion 121, the second portion 122, and the third portion 123 is changed to L=23 mm, L=24 mm, L=25 mm, and L=27 mm, there is almost no change in the frequency at which the value of the parameter S11 decreased locally (at approximately 2.65 to approximately 2.75 GHz). On the other hand, there is a large change in the frequency at which the value of the parameter S12 decreased locally (at approximately 2.3 to approximately 2.8 GHz). With the multi-antenna device 10, the passive element 12 is configured so as to include the first portion 121, which is coupled to the feeding element 11 and grounded at one end, the second portion 122, which is coupled to the feeding element 11 and grounded at one end, and the third portion 123, which is grounded at one end via the serially connected member having inductance (e.g., the inductor 125) and is connected at the other end to the other ends of the first portion 121 and the second portion 122. With this arrangement, when the electrical length L of the first portion 121, the second portion 122, and the third portion 123 is changed, the frequency at which the value of the parameter S12 decreases locally can be greatly changed, almost without changing the frequency at which the value of the parameter S11 decreases locally. Accordingly, the adjustment of the frequency (e.g., resonance frequency) at which the cross coupling between the antenna elements 111 and 112 can be effectively decreased can be easily accomplished merely by adjusting (or changing) the electrical length L of the first portion 121, the second portion 122, and the third portion 123.

The embodiment disclosed herein is in every respect illustrative and should not be construed as being limiting in nature. The scope of the present invention is indicated not by the above description of the embodiment, but by the patent claims, and encompasses all modifications in meaning and scope that are equivalent to the patent claims.

In the illustrated embodiment, the portable telephone 100 is given as an example of the communication apparatus having the multi-antenna device of the present application. However, the present application is not limited to or by this. The present application can also be applied to a communication apparatus other than the portable telephone 100, such as a PDA (personal digital assistant), a personal computer, or an STB (set-top box), that is equipped with the multi-antenna device 10.

In the illustrated embodiment, the multi-antenna device 10 used for MIMO communication is given as an example of the multi-antenna device of the present application. However, the present application is not limited to or by this. The multi-antenna device 10 can be compatible with a technique other than MIMO, such as a diversity scheme.

In the illustrated embodiment, the multi-antenna device 10 is configured so as to correspond to WiMAX in the 2.5 GHz band. However, the present application is not limited to or by this. The multi-antenna device 10 can also be compatible with a frequency other than the 2.5 GHz band, or can be compatible with a format other than WiMAX, such as GSM (Trademark) or 3G.

In the illustrated embodiment, the first and second antenna elements 111 and 112 forming a monopole antenna is given as an example of the first and second antenna elements of the present application, respectively. However, the present application is not limited to or by this. The present application can be applied to first and second antenna elements other than a monopole antenna, such as a dipole antenna.

Figure 11:
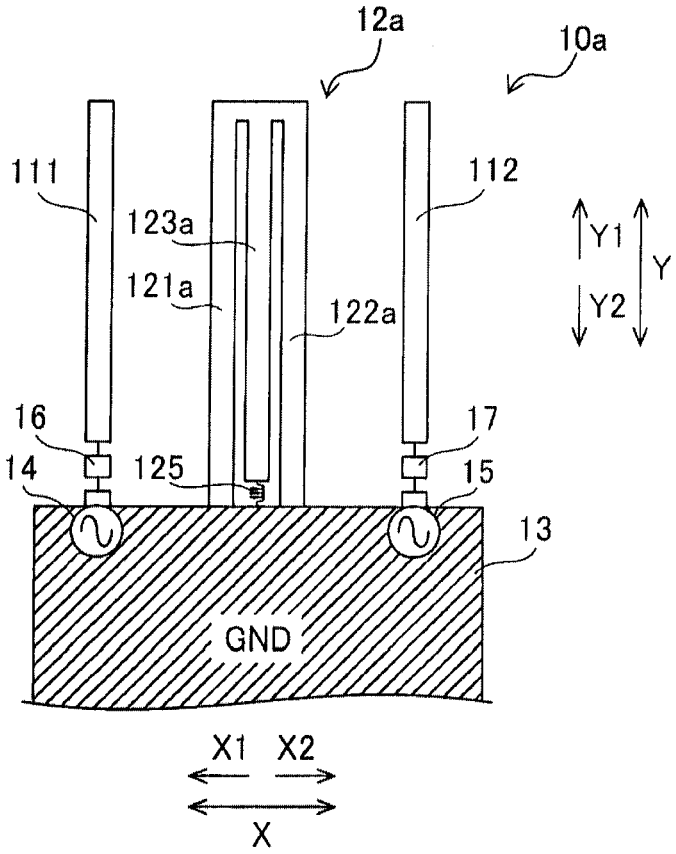
FIG. 11 is an elevational view of a multi-antenna device in accordance with a modified embodiment of the present application.

In the illustrated embodiment, the third portion 123 of the passive element 12 is disposed in a different plane (e.g., the surface on the rear side of the substrate) from a plane in which the first portion 121 and the second portion 122 are disposed. However, the present application is not limited to or by this. With the present application, either the first portion 121, the second portion 122, or the third portion 123 can be disposed in a different plane from at least one of the others. Also, with the present application, as shown in FIG. 11, a modified multi-antenna device 10*a* can include a modified passive element 12*a* with first, second and third portions 121*a*, 122*a* and 123*a*. The modified multi-antenna device 10*a* is identical to the multi-antenna device 10 of the illustrated embodiment, except that the first, second and third portions 121*a*, 122*a* and 123*a* of the modified passive element 12*a* are all disposed in the same plane. Thus, detailed description of the modified multi-antenna device 10*a* will be omitted for the sake of brevity. In this case, the first antenna element 111 and the second antenna element 112 can also be disposed in the same plane as the plane in which the first portion 121*a*, the second portion 122*a*, and the third portion 123*a* are disposed. Consequently, the feeding element 11 and the modified passive element 12*a* are disposed in the same plane. Thus, fewer planes need to be provided for disposing the feeding element 11 and the modified passive element 12*a*.

Also, the faces to which the first and second antenna elements 111 and 112, and the first, second and third portions 121, 122 and 123 of the passive element 12 are provided are not limited to the surface on the front side of the substrate or the surface on the rear side of the substrate. The faces can be a face on the inside of the substrate (e.g., the surface of an intermediate layer).

Figure 12:
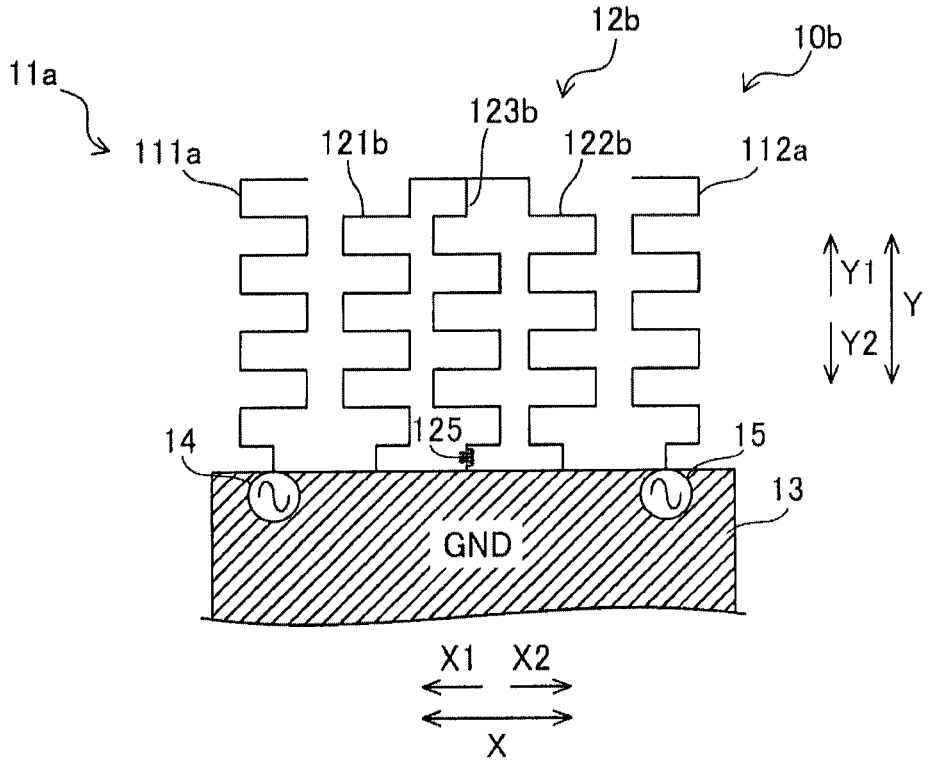
FIG. 12 is an elevation view of a multi-antenna device in accordance with a modified embodiment of the present application.

In the illustrated embodiment, the first and second antenna elements 111 and 112 and the first, second and third portions 121, 122 and 123 of the passive element 12 are each formed in a linear shape. However, the present application is not limited to or by this. For example, as shown in FIG. 12, a modified multi-antenna device 10*b* can include a modified feeding element 11*a* with first and second antenna elements 111*a* and 112*a*, and a modified passive element 12*b* with first, second and third portions 121*b*, 122*b* and 123*b*. The modified multi-antenna device 10*b* is identical to the multi-antenna device 10 of the illustrated embodiment, except that the first and second antenna elements 111*a* and 112*a* of the modified feeding element 11*a* and the first, second and third portions 121*b*, 122*b* and 123*b* of the passive element 12*b* each are formed in a meander or crenellated shape that bends or curves at a plurality of positions. Also, just part of the first and second antenna elements 111*a* and 112*a*, and the first, second and third portions 121*b*, 122*b* and 123*b* can be formed in a crenellated shape that bends or curves at a plurality of positions. However, it is preferable that the first antenna element 111*a* and the second antenna element 112*a* are in line symmetry with each other with respect to a reference line that passes through the center point between the first feed point 14 and the second feed point 15, and that the first portion 121*b* and the second portion 122*b* are also in line symmetry with each other with respect to this reference line.

In the illustrated embodiment, the inductor 125 is given as an example of the member having inductance in the present application. However, the present application is not limited to or by this. As long as it has inductance, this member can be something other than the inductor, such as a member having inductance as a result of a pattern (or wiring pattern) provided to a substrate.

In the illustrated embodiment, the first, second and third portions 121, 122 and 123 are disposed so as not to overlap each other in plan view. However, the present application is not limited to or by this. With the present application, for example, the first, second and third portions 121, 122 and 123 can be disposed so that they overlap each other in plan view. In this case, it is preferable that the first portion 121 is disposed more to the first antenna element 111 side than the second portion 122 and the third portion 123, and that the second portion 122 is disposed more to the second antenna element 112 side than the first portion 121 and the third portion 123.

Figure 9:
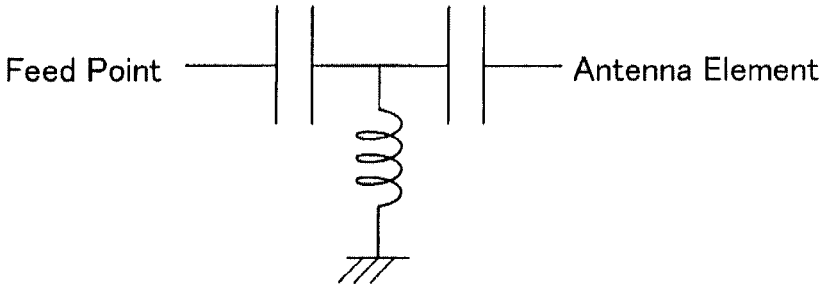
FIG. 9 is a simplified circuit diagram of a T-shaped matching circuit used in a modified embodiment of the present application.
Figure 10:
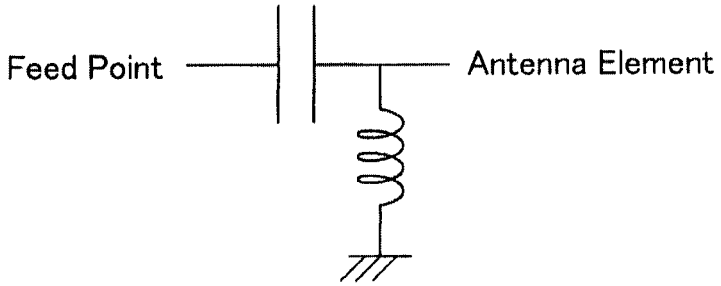
FIG. 10 is a simplified circuit diagram an L-shaped matching circuit used in a modified embodiment of the present application.

In the illustrated embodiment, the t-shaped circuit (e.g., π matching) made up of the inductor (e.g., the coil) and the capacitor is given as an example of the first and second matching circuits 16 and 17 of the present application. However, the present application is not limited to or by this. With the present application, for example, a matching circuit other than the π-shaped circuit can be used, such as a T-shaped circuit (e.g., T matching) made up of an inductor (e.g., a coil) and a capacitor as shown in FIG. 9, or an L-shaped circuit (e.g., L matching) made up of an inductor (e.g., a coil) and a capacitor as shown in FIG. 10. Also, the π-shaped circuit, T-shaped circuit, L-shaped circuit, or the like can be made up of one of an inductor (e.g., a coil) and a capacitor.

With a multi-antenna device of the present application, cross coupling between antenna elements can be reduced, and a more compact size can be achieved. Specifically, with the multi-antenna device, a passive element disposed between a first antenna element and a second antenna element is configured such that it includes a first portion that is coupled to a feeding element and is grounded at one end, a second portion that is coupled to the feeding element and is grounded at one end, and a third portion that is grounded at one end via a serially connected member having inductance and that is connected at the other end to the other ends of the first portion and the second portion.

Specifically, with the multi-antenna device of the present application, the feeding element includes the first antenna element and the second antenna element, and the passive element is disposed between the first antenna element and the second antenna element. The passive element includes the first portion that is coupled to the feeding element and is grounded at one end, the second portion that is coupled to the feeding element and is grounded at one end, and the third portion that is grounded at one end via the serially connected member having inductance and that is connected at the other end to the other ends of the first portion and the second portion.

With this multi-antenna device, the passive element disposed between the first antenna element and the second antenna element is configured such that it includes the first portion that is coupled to the feeding element and is grounded at one end, the second portion that is coupled to the feeding element and is grounded at one end, and the third portion that is grounded at one end via the serially connected member having inductance and that is connected at the other end to the other ends of the first portion and the second portion. Thus, the cross coupling between the antenna elements can be reduced without having to form the passive element including the first portion, second portion, and third portion so as to extend in a direction in which the first antenna element and the second antenna element oppose each other. Consequently, there is no need to increase the distance between antenna elements to reduce the cross coupling between the antenna elements. Furthermore, unlike when the passive element is formed so as to extend in a direction in which the first antenna element and the second antenna element oppose each other, the distance between the antenna elements can be made shorter. Therefore, with this multi-antenna device, the cross coupling between the antenna elements can be reduced, and a more compact size achieved.

Also, the passive element is configured so as to include the first portion that is coupled to the feeding element and is grounded at one end, the second portion that is coupled to the feeding element and is grounded at one end, and the third portion that is grounded at one end via the serially connected member having inductance and that is connected at the other end to the other ends of the first portion and the second portion. Thus, adjustment of the frequency at which the cross coupling between the antenna elements can be effectively reduced (e.g., resonance frequency) can be easily accomplished merely by adjusting the length of the various parts of the passive element. As a result, this affords a simpler design of the multi-antenna device.

With this multi-antenna device, the first portion of the passive element is disposed more to the first antenna element side than the second portion and the third portion, while the second portion of the passive element is disposed more to the second antenna element side than the first portion and the third portion. With this configuration, the first portion of the passive element can be reliably coupled to the first antenna element, and the second portion can be reliably coupled to the second antenna element. As a result, the cross coupling between the antenna elements can be reduced and the distance between the antenna elements can be shortened more reliably.

With this multi-antenna device, the one end of the third portion is grounded via the serially connected inductor. With this configuration, the design of the multi-antenna device can be further simplified by using the inductor with which the amount of inductance can be easily adjusted.

With this multi-antenna device, either the first portion, the second portion, or the third portion of the passive element is disposed in a different plane from that of at least one of the other portions. With this configuration, the first portion, second portion, and third portion of the passive element can be disposed so as to be closer to or overlap each other in plan view. Thus, the passive element can be disposed in a smaller space in plan view. As a result, an even more compact multi-antenna device can be obtained.

In this case, it is preferable if the third portion of the passive element is disposed in a different plane from that of both the first portion and the second portion. With this configuration, the third portion of the passive element can be disposed so as to be closer to or overlap the first portion and the second portion in plan view. Thus, the passive element can easily be disposed in a smaller space in plan view.

With this multi-antenna device, the first portion, second portion, and third portion of the passive element each have an electrical length of approximately one-fourth the wavelength λ of the electrical waves outputted by the first antenna element and the second antenna element. With this configuration, the passive element, including the first portion, second portion, and third portion, can resonate at close to the corresponding frequency.

With this multi-antenna device, the device further includes a first feed point for supplying high-frequency power to the first antenna element, a second feed point for supplying high-frequency power to the second antenna element, a first matching circuit that is disposed between the first antenna element and the first feed point, for impedance matching at a specific frequency of high-frequency power, and a second matching circuit that is disposed between the second antenna element and the second feed point, for impedance matching at a specific frequency of high-frequency power. With this configuration, the cross coupling between the antenna elements can be reduced and impedance matching can be achieved at the specific frequency. Thus, transmission loss of energy transmitted through the antenna elements can be reduced.

With this multi-antenna device, the first portion, second portion, and third portion of the passive element are disposed so that they are spaced apart from each other by a distance that is less than an electrical length of approximately one-tenth the wavelength λ of the electrical waves outputted by the first antenna element and the second antenna element. With this configuration, the first portion, second portion, and third portion can be disposed so that they are spaced apart from each other at a shorter distance. Thus, the passive element can be disposed in a smaller space. As a result, an even more compact multi-antenna device can be obtained.

With this multi-antenna device, the first portion, second portion, and third portion of the passive element are disposed substantially parallel to each other. With this configuration, the first portion, second portion, and third portion are disposed next to each other. Thus, the passive element can be disposed in a smaller space. As a result, an even more compact multi-antenna device can be obtained.

In this case, it is preferable if the first portion, second portion, and third portion of the passive element are formed so as to extend in a straight line in a direction that is substantially perpendicular to the direction in which the first antenna element and the second antenna element oppose each other. With this configuration, the width of the passive element can be further reduced in the direction in which the first antenna element and the second antenna element oppose each other. Thus, the distance between the antenna elements can be further reduced.

With this multi-antenna device, the first antenna element and the second antenna element include a monopole antenna. With this configuration, a more compact multi-antenna device can be obtained by utilizing the monopole antenna that is smaller than a dipole antenna.

A communication apparatus of the present application includes the multi-antenna device that includes a feeding element with first and second antenna elements and a passive element disposed between the first antenna element and the second antenna element. The passive element includes a first portion that is coupled to the feeding element and is grounded at one end, a second portion that is coupled to the feeding element and is grounded at one end, and a third portion that is grounded at one end via a serially connected member having inductance and that is connected at the other end to the other ends of the first portion and the second portion.

With this communication apparatus, the passive element disposed between the first antenna element and the second antenna element is configured so as to include the first portion that is coupled to the feeding element and is grounded at one end, the second portion that is coupled to the feeding element and is grounded at one end, and the third portion that is grounded at one end via the serially connected member having inductance and that is connected at the other end to the other ends of the first portion and the second portion. Thus, cross coupling between the antenna elements can be reduced without forming the passive element including the first portion, second portion, and third portion so as to extend in a direction in which the first antenna element and the second antenna element oppose each other. Consequently, there is no need to increase the distance between the antenna elements in order to reduce the cross coupling between the antenna elements. Therefore, unlike when the passive element is formed so as to extend in a direction in which the first antenna element and the second antenna element oppose each other, the cross coupling between the antenna elements can be reduced while a more compact size can be achieved. Also, the communication apparatus equipped with this multi-antenna device can itself be made more compact. The present application is particularly effective with a communication apparatus that needs to be smaller, such as a portable telephone.

Also, if the passive element is configured so as to include the first portion that is coupled to the feeding element and is grounded at one end, the second portion that is coupled to the feeding element and is grounded at one end, and the third portion that is grounded at one end via the serially connected member having inductance and that is connected at the other end to the other ends of the first portion and the second portion. Thus, adjustment of the frequency at which the cross coupling between the antenna elements can be effectively reduced can be easily accomplished merely by adjusting the length of the various parts of the passive element. As a result, this affords a simpler design of the multi-antenna device and the communication apparatus.

With the present application, the cross coupling between the antenna elements can be reduced while a more compact multi-antenna device can be obtained.

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts.

While only a preferred embodiment has been chosen to illustrate the present invention, it will be apparent to those skilled in the art from this disclosure that various changes and modifications can be made herein without departing from the scope of the invention as defined in the appended claims. Furthermore, the foregoing descriptions of the embodiment according to the present invention are provided for illustration only, and not for the purpose of limiting the invention as defined by the appended claims and their equivalents.

What is claimed is:

1. A multi-antenna device comprising:

a feeding element having first and second antenna elements; and a passive element disposed between the first and second antenna elements, the passive element having a first portion that is directly grounded at one end, a second portion that is directly grounded at one end and a third portion that is grounded at one end via a serially connected member including an inductor with inductance such that the one end of the third portion is grounded in a different manner from the one ends of the first and second portions, the third portion being connected at the other end to the other ends of the first and second portions, the third portion of the passive element being disposed in a plane different from a plane in which the first and second portions of the passive element are disposed.

2. The multi-antenna device according to claim 1, wherein the first portion of the passive element is electromagnetically coupled to the feeding element, and the second portion of the passive element is electromagnetically coupled to the feeding element.

3. The multi-antenna device according to claim 1, wherein the first portion of the passive element is disposed closer to the first antenna element than the second and third portions are, and the second portion of the passive element is disposed closer to the second antenna element than the first and third portions are.

4. The multi-antenna device according to claim 1, wherein the first, second and third portions of the passive element have an electrical length of approximately one-fourth a wavelength of radio waves outputted by the first and second antenna elements.

5. The multi-antenna device according to claim 1, further comprising, a first feed point configured to supply first high-frequency power to the first antenna element, a second feed point configured to supply second high-frequency power to the second antenna element, a first matching circuit disposed between the first antenna element and the first feed point, the first matching circuit being configured to perform impedance matching at a specific frequency of the first high-frequency power; and a second matching circuit disposed between the second antenna element and the second feed point, the second matching circuit being configured to perform impedance matching at a specific frequency of the second high-frequency power.

6. The multi-antenna device according to claim 1, wherein the first, second and third portions of the passive element are spaced apart from each other by a predetermined distance that is less than an electrical length of approximately one-tenth a wavelength of radio waves outputted by the first and second antenna elements.

7. The multi-antenna device according to claim 1, wherein the first, second and third portions of the passive element are disposed substantially parallel to each other.

8. The multi-antenna device according to claim 7, wherein the first, second and third portions of the passive element extend in a direction that is substantially perpendicular to a direction in which the first and second antenna elements oppose each other.

9. The multi-antenna device according to claim 1, wherein the first and second antenna elements include a monopole antenna.

10. A communication apparatus comprising:

a multi-antenna device having a feeding element having first and second antenna elements, and a passive element disposed between the first and second antenna elements, the passive element having a first portion that is directly grounded at one end, a second portion that is directly grounded at one end and a third portion that is grounded at one end via a serially connected member including an inductor with inductance such that the one end of the third portion is grounded in a different manner from the one ends of the first and second portions, the third portion being connected at the other end to the other ends of the first and second portions, the third portion of the passive element being disposed in a plane different from a plane in which the first and second portions of the passive element are disposed.

* * * * *